United States Patent [19]

Hann et al.

[11] Patent Number: 4,914,078

[45] Date of Patent: Apr. 3, 1990

[54] THERMAL TRANSFER RECEIVER

[75] Inventors: Richard A. Hann, Frodsham; Nicholas C. Beck, Runcorn, both of England

[73] Assignee: Imperial Chemical Industries PLC, London, England

[21] Appl. No.: 185,875

[22] Filed: Apr. 25, 1988

[30] Foreign Application Priority Data

Apr. 24, 1987 [GB] United Kingdom ..... 8709800

[51] Int. Cl.[4] ..... B41M 5/035; B41M 5/26

[52] U.S. Cl. ..... 503/227; 8/471; 428/195; 428/447; 428/480; 428/482; 428/913; 428/914

[58] Field of Search ..... 8/471; 428/447, 480, 428/482, 913, 914, 195; 503/227

[56] References Cited

U.S. PATENT DOCUMENTS 4,626,256 12/1986 Kawasaki et al. ..... 8/471

4,720,480 1/1988 Ito et al. ..... 503/227

*Primary Examiner*—Bruce H. Hess

*Attorney, Agent, or Firm*—Cushman, Darby & Cushman

[57] ABSTRACT

A receiver sheet for dye-diffusion thermal transfer printing, comprises a substrate which supports a receiver coat, the receiver coat comprising a dye-receptive material, such as an organic polymer, and a dye-permeable release agent which is a thermoset amino-modified-silicone organic-oligoepoxide resin. The thermoset combination of silicon and organic moieties in the release agent, gives good protection against adhesion between the dyesheet and receiver sheet when they are subjected to short high temperature pulses during printing, while also enabling sharp images of high optical density to be obtained. This balance of properties is best obtained by dispersing the release agent throughout the dye-receptive material, although they can also be applied to the substrate as separate layers.

8 Claims, No Drawings

THERMAL TRANSFER RECEIVER

The invention relates to receiver sheets for dye-diffusion thermal transfer printing, processes for their preparation, and the use of certain polymers therein.

Dye-diffusion thermal transfer printing ("TTP") is a printing process in which one or more thermally transferable dyes are caused to transfer from a dyesheet to a receiver sheet in response to thermal stimuli. Sometimes this process is referred to as sublimation transfer printing, irrespective of whether transfer is effected by sublimation or by some other direct mechanism. A TTP dyesheet comprises a substrate having on one side a dyecoat comprising a thermally transferable dye, usually dispersed in a binder. When the dyecoat is held against a dye receptive surface of a receiver sheet and a selected area (e.g. a single pixel of design) is heated, dye is caused to transfer from the heated area of the dyecoat to the receiver sheet. When this process is working well, only the dye is transferred, any binder in the dyecoat being retained on the dyesheet. (In this it may be contrasted with wax thermal transfer printing, wherein the dyecoat has a fusible binder (usually wax) which melts under a thermal stimulus to transfer the binder together with any dye or pigment dispersed in it.) High resolution printing can be effected by heating selected small areas of the dyesheet using, for example, a programmable thermal print head or laser to transfer individual pixels or groups of pixels.

TTP can be used for printing onto a variety of receiver sheets formed of dye-receptive materials. Typical for example, are thermoplastic films (usually biaxially orientated polyethylene terephthalate ("PET") film to take advantage of the latter's good dimensional stability) coated with a layer of dye-receptive material. Other receiver sheets include various papers, which may themselves by dye-receptive although these also generally benefit from having a coating of a dye-receptive material.

High speed printing can be achieved by using short duration pulses at higher temperatures, but the resultant localised high temeratures have led in the past to local melt bonding between the dyesheet and the receiver sheet, thereby transferring areas of the dyecoat (including binder) unpredictably to the receiver sheet. It has previously been proposed that this might be mitigated to some extent, inter alia, by using cross-linked release agents on the receiver sheet, but known release agents have not proved entirely successful, tending at one extreme to restrict flow of the dye molecules, giving patchiness or poor optical density, or on the other hand tending not to prevent adhesion between the sheets. We have now found that by selecting other specific thermosetting resins, based on interacted combinations of silicone and organic moieties, we can minimise the adhesion while obtaining a rapid precise transfer of the dyes, especially at the higher optical densities at which adhesion problems generally occur.

Accordingly, a first aspect of the present invention provides a thermal transfer printing receiver sheet comprising a substrate which supports a receiver coat, the receiver coat comprising a dye-receptive material and a dye-permeable release agent, characterised in that the release agent is a thermoset amino-modified-silicone organic-oligoepoxide resin.

A second aspect of the present invention provides a receiver coat composition for use in the receiver coats of the first aspect of the invention characterised by comprising a thermoset amino-modified-silicone organic-oligoepoxide resin release agent.

A third aspect of the present invention provides the use of a thermoset amino-modified-silicone organic-oligoepoxide resin as a release agent in a thermal transfer printing receiver sheet.

A fourth aspect of the present invention provides a process for the preparation of a receiver sheet of the first aspect of the present invention, characterised by applying a precursor composition for a receiver coat composition of the second aspect of the invention to a substrate.

A fifth aspect of the present invention provides a precursor composition for a receiver coat for use in the process of the fourth aspect of the present invention, characterised in that it comprises a costable liquid composition comprising an amino-modified-silicone organic-oligoepoxide resin or a reaction mixture of an amino-modified silicone and an organic oligoepoxide.

The receiver coat may comprise a plurality of component layers of different compositions, including a first layer comprising the dye-receptive material and a release coat forming a second layer overlying the first layer and comprising the release agent. The release coat may consist essentially of the release agent on its own, or comprise a composition in which the release agent is dispersed in a polymeric binder, e.g. to improve its film-forming properties or the uptake of dye. The release coat may overlie part or all of the dye-receptive material, being suitably 0.01 to 5 micron thick.

Preferably, however the receiver coat has no separate release coat but comprises the release agent dispersed throughout the dye-receptive material, the latter being typically an organic polymer. Examples of suitable polymers include the following, where reference to a homopolymer includes corresponding copolymers: polyesters and polycarbonates, polylactones, polyamides, polyurethanes, polyureas, polyacrylates, and polyvinyls (including polyvinylacetates and -chlorides and polyacrylonitriles), and mixtures thereof.

Preferably the polymer is soluble in an organic solvent so that as part of the receiver coat it may be applied in solution to the substrate in preparation of the receiver coat in accordance with the fourth aspect of the invention. Preferred polymers of this type include soluble polyesters such as Vylon 103, Vylon 200 (Toyobo) and Vitel VPE 200 (Goodyear) and soluble vinyl chloride-vinyl acetate copolymers such as Corvic grades CL 4317 and CL 5440 (ICI). Mixtures of these polyesters and the latter copolymers are also of interest, for example ones in which the polyester forms 70 to 30% by weight of the mixture.

The solubility of such polymers in suitable vehicles (described in further detail in connection with the process of the fourth aspect of the present invention) is to some extent dependent on the chemical nature and average molecular weights of the polymers. Suitable polymers and vehicles may be readily determined by routine trial.

The receiver coat when dry is typically 0.5 to 12 micron thick, preferably 2 to 6 micron.

The release agent is an amino-modified-silicone organic-oligoepoxide resin and may be prepared as the reaction product of an amino-modified silicone and an organic oligoepoxide, reacted ex situ or preferably in situ in a precursor of the receiver or release coat to given the corresponding coat comprising the release agent.

Suitable amino-modified silicones include M468 (ICI) and KF-393 (Shin Etsu). Favoured silicones include M468.

Organic oligoepoxides are any organic species (i.e. excluding any polysiloxane moiety) containing a plurality of epoxide functions, for example 2 to 10, in particular 2, such functions. Suitable organic oligoepoxides include Diepoxide 126 (Degussa) which is a bis-(epoxycyclohexane) with an ester linkage between the cyclohexane residues, Diepoxide 183 (Degussa) which is a bis-(epoxycyclohexane) with a flexible linkage between the cyclohexane residues, and Araldite GY 1558 GB (Ciba Geigy) which is an epoxidised phenol novolac resin. Favoured oligoepoxides include Diepoxide 126.

Where the release agent is dispersed in the receiver coat it may suitably be present as 0.5 to 20% by weight of the receiver coat, for example 1 to 10% by weight. The optimum proportion of the release agent to the polymeric matrix material can however vary according to the specific agent used, inter alia on its degree of cross-linking, the specific matrix materials and the compatibility of the release agent with the dyestuffs to be used with it in TTP.

The substrate for use with the present receiver coat and precursor composition, desirably is of a material which has sufficient mechanical strength to be handled without particular care in a TTP process, even when heated to the temperatures conventionally found in TTP, in particular those higher temperatures found in high-speed TTP as described hereinbefore.

For these reasons, suitable examples of the substrate include any flexible thin sheet of paper having a high degree of sizing, or a flexible thin thermoplastics film, for example a polyester, or PVC or polypropylene film, either as a single layer or as a multilayer structure. Thermoplastics films are especially useful for their dimensional stability and resistance to moisture absorption, and for handling in mechanical apparatus in view of their relatively good resistance to fracture; polyesters, in particular linear polyesters are favoured. Suitable such polyesters include those of dicarboxylic aromatic acids with one or more glycols. Polyethylene terephthalate ('PET') is particularly preferred.

A polyester film which has been at least uniaxially, but preferably biaxially orientated is especially preferred, in particular such a PET film. This may be done by conventional stretching or sequential or synchronous stretching in two mutually perpendicular directions respectively, typically at 70° to 125° C., preferably with a heat set at e.g. 150° to 250° C. as described in GB-A 838 708.

Depending on its desired use, the substrate of the receiver sheet can be transparent or opaque. Transparent substrate materials can be rendered opaque by being voided by incorporating a voiding agent, i.e. a material which is immiscible with the substrate polymer in production and use, e.g. an inorganic or resin filler. Suitable inorganic fillers include kaolin, oxides such as alumina, silica and titania, and alkaline earth salts such as carbonates and sulphates of calcium and barium. Suitable resins include polyamides and olefin (especially $C_{1-6}$ olefin) co- and homo-polymers. If voided, the average particle size of the voiding agent is desirably 0.1 to 10 micron preferably 0.2 to 0.5 micron with virtually no particle greater than 30 micron. Decreasing particle size increases the substrate gloss. Especially preferred films include Melinex biaxilly orientated PET films (ICI).

The thickness of the substrate is typically of the order of 40 to 260 micron, preferably 100 to 175 micron.

The process of the fourth aspect of the present invention may be effected for example by co-extruding a mutually adherent substrate and a layer of dye-receptive material, and then optionally spreading a release coat precursor on to the dye-receptive layer to form the receive coat. Alternatively, the dye-receptive layer may be spread onto a preformed substrate and then a release coat precursor spread on to the dye-receptive layer to complete the receiver coat. Preferably however only a single receiver coat precursor (i.e. containing both the dye-receptive materials and the release agent or a precursor thereof) is spread onto the substrate and is then converted to the receiver coat.

In the most preferred process variant, a precursor of the receiver coat may be spread onto the substrate using conventional film-coating techniques, for example, Meyer bars or K-bars, bead coating or gravure rollers.

The precursor of the receiver coat may typically be a dispersion or solution in a suitable vehicle, of the matrix polymer and the release agent, or the two component precursors thereof, together with any necessary catalyst. Suitable vehicles include arenes, such as toluene, and ketones, such as methyl ethyl ketone and mixtures thereof, which may subsequently be removed by evaporation.

Where the receiver coat precursor comprises the release agent precursors, appropriate conventional curing techniques may be used in the conversion process. For example, any coating vehicle may be removed by evaporation, and reaction of precursors to the desired release agent may be effected in a single step by heating at 100° to 170° C. for 20 sec to 8 min. Lower temperatures generally require longer cure times and/or a catalyst. Suitable catalysts include Sn(IV) species such as dibutylin dilaurate, and 1,4;-diazabicyclo[2.2.2]octane ("DABCO"). The material can be heated on the roll to complete the cure, but the temperature should be reduced below the glass transition temperature of the receiver coat (which may be relatively low for some materials) before that is allowed to contact other materials, to avoid adhesion.

The receiver sheets of the present invention may be used in any conventional TTP process. They may for example be used only once for single colour prints, or several times sequentially for multicolour prints (where it acts as a single receiver sheet for several dyesheets or colour blocks on a dyesheet roll sequentially.

The present invention is illustrated by the following Examples.

EXAMPLE 1

Precursor composition for receiver coat:

| | | |
|---|---|---|
| Solution A | Vylon 103 (Toyobo) | 9.0 parts |
| | toluene | 40.0 parts |
| | methyl ethyl ketone | 40.0 parts |
| Solution B | amino silicone M468 (ICI) | 0.39 parts |
| | toluene | 10.00 parts |
| Solution C | Diepoxide 126 (Degussa) | 0.06 parts |
| | toluene | 10.00 parts |

The three solutions A, B and C were prepared separately and mixed, with stirring, just before coating. Solution A was filtered with a 0.45 micron filter before mixing to remove impurities in the copolyester. The solution was coated onto a white substrate of 125 micron thick '990' Melinex biaxially orientated PET film substrate with a No. 5 K-bar. This gave a wet coat thickness of 50 microns, resulting in a dry coat thickness of 3 microns. The coat was then cured to give a TTP receiver sheet having a single receiver coat composition of the present invention. Suitable cure conditions were a temperature of 150° C. for a period of 1 minute or a temperature of 120° C. for a period of 6 minutes, or temperatures and times between the above figures.

This receiver sheet was printed using a set of standard dyesheets of three colours, yellow, magenta and cyan. Each dyesheet comprised a biaxially oriented polyethylene terephthalate substrate of about 6 micron thickness, having on one surface a backing coat with a high softening point and good release properties and on the other a transfer layer of about 2 micron thickness comprising a dye in a cellulosic resin binder.

The receiver sheet and one of the dyesheets, with their respective transfer layer and receiver coat in contact, were together placed onto a rubber-covered drum of a thermal transfer printing machine, and contacted with a print head comprising a linear array of small heaters spaced apart at a linear density of 6/mm, each heater being capable of being selectively activated individually in accordance with a pattern information signal, to transfer a small quantity of dye to the receiver sheet and form a single pixel of the pattern. In the tests the heaters were activated to give a temperature of about 350° C. (power supply being 0.32 watt/pixel) for periods of to 10 milliseconds (ms), dye being thereby transferred from the transfer layer of the dyesheet to the receiver coat of the receiver sheet held adjacent to it.

No difficulty was experienced in stripping the dyesheet from the receiver sheet, and afterwards the image on the latter was assessed using a Sakura Densitometer (Konishiroku Photo), type PDA 65, operating in the reflection mode with an appropriate filter. The measured reflection optical density (ROD) of the ink image was found to be good compared with images prepared in a similar manner on receiver sheets using conventional release agents, with the same dyesheets.

EXAMPLE 2

A receiver sheet was prepared using the precursor composition, substrate and procedures of Example 1, except that the Vylon 103 dye-receptive material was replaced by a 50:50 by weight mixture of Vylon 200 (Toyobo) and a Corvic polymer, grade CL4317 (ICI), in the precursor composition for the receiver coat. A similar good balance of optical density in the image and freedom from adhesion between the sheets was obtained.

EXAMPLE 3

A receiver sheet having a receiver coat formed as a plurality of component layers was prepared using the solutions A, B and C of Example 1, but applying them in part sequentially. Solution A was first coated alone onto the substrate by the method described in Example 1, and dried at 120° C. for 6 minutes to give a dry polymer coat about 3 microns thick, thereby to provide a layer of dye-receptive material. A mixture of solutions B and C was then similarly coated onto the residues of A, but with a No. 1 k-bar, and cured as in Example 1. This gave a receiver sheet having a receiver coat comprising a dye-permeable release coat about 0.10 micron thick, overlying the dye-receptive material. No adhesion between the sheets was detected as they were pulled apart, and although the optical densities obtained fell short of those obtained in Example 1, the results were better than we obtained with similar multilayer sheets produced using known release agents.

EXAMPLE 4

Precursor composition for the receiver coat:

| | | |
|---|---|---|
| Solution A | Vylon 103 | 9.5 parts |
| | toluene | 40.0 parts |
| | methyl ethyl ketone | 40.0 parts |
| Solution B | amino silicone M468 | 0.0162 parts |
| | toluene | 10.0 parts |
| Solution C | Diepoxide 126 | 0.0027 parts |
| | toluene | 10.0 parts |

The three solutions A, B and C were prepared separately and mixed with stirring, just before coating. Solution A was filtered with a 0.45 micron filter before mixing to remove impurities in the polyester. The solution was coated onto 125 micron thick '990' Melinex base with a No. 5 K-bar. This gave a wet coat thickness of 50 microns, resulting in a dry coat thickness of 3 microns. The coat was then cured. Suitable cure conditions were a temperature of 150° C. for a period of 1 minute or a temperature of 120° C. for a period of 6 minutes, or temperatures and times between the above figures.

This receiver sheet was printed using magenta dyesheet, in the manner of Example 1. No undue adhesion while parting the sheets was noticed, the resultant images having good, uniform optical densities.

EXAMPLE 5

Precursor composition for receiver coat:

| | | |
|---|---|---|
| Solution A | Vylon 103 | 8.6 parts |
| | toluene | 40.0 parts |
| | methyl ethyl ketone | 40.0 parts |
| Solution B | amino silicone M468 | 0.74 parts |
| | toluene | 10.00 parts |
| Solution C | Diepoxide 126 | 0.12 parts |
| | toluene | 10.00 parts |

The three solutions A, B and C were prepared separately and mixed, with stirring, just before coating. Solution A was filtered with a 0.45 micron filter before mixing to remove impurities in the copolyester. The solution was coated onto 125 micron thick '990' Melinex base with a No. 5 K-bar. This gave a wet coat thickness of 50 microns, resulting in a dry coat thickness of 3 microns. The coat was then cured. Suitable cure conditions were a temperature of 150° C. for a period of 40 seconds or a temperature of 120° C. for a period of 6 minutes, or temperatures and times between the above figures.

The receiver sheet thus produced was used with a magenta dyesheet in TTP as in Example 1 to give good optical densities and uniform images.

EXAMPLE 6

Precursor composition for receiver coat:

| | | |
|---|---|---|
| Solution A | Vylon 103 | 9.0 parts |
| | toluene | 40.0 parts |
| | methyl ethyl ketone | 40.0 parts |

-continued

| | | |
|---|---|---|
| Solution B | amino silicone M468 | 0.39 parts |
| | toluene | 10.00 parts |
| Solution C | Diepoxide 126 | 0.06 parts |
| | toluene | 10.00 parts |
| Solution D | DABCO | 0.05 parts |
| | toluene | 1.00 parts |

The four solutions A, B, C and D were prepared separately and mixed, with stirring, just before coating. Solution A was filtered with a 0.45 micron filter before mixing to remove impurities in the copolyester. The solution was coated onto 125 micron thick '990' Melinex base by the method of bead coating. The film speed was 5 m/min, the application speed was 10 rpm and the application gap was 6 thou. This gave a dry coat thickness of approximately 3 microns. The coat was cured as in Example 1.

This receiver was printed with a set of dyesheets of three colours, yellow, magenta and cyan using a thermal printer as in Example 1 to give good optical densities.

EXAMPLE 7

Precursor composition for receiver coat:

| | | |
|---|---|---|
| Solution A | Vylon 103 | 5.8 parts |
| | Corvic 4317 | 3.1 parts |
| | toluene | 40.0 parts |
| | methyl ethyl ketone | 40.0 parts |
| Solution B | amino silicone M468 | 0.39 parts |
| | toluene | 10.00 parts |
| Solution C | Diepoxide 126 | 0.06 parts |
| | toluene | 10.00 parts |

The three solutions A, B, and C were prepared separately and mixed, with stirring, just before coating. Solution A was filtered with a 0.45 micron filter before mixing to remove impurities in the copolyester. The solution was coated onto 125 micron thick '990' Melinex base by the method of bead coating. The film speed was 5 m/min, the application speed was 10 rpm and the application gap was 6 thou. This gave a dry coat thickness of approximately 2 microns. The coat was cured online at a temperature of 150° C. for 1 minute.

This receiver was printed with a set of dyesheets of three colours, yellow, magenta and cyan, using a thermal printer as in Example 1 to give sharp, uniform images having good optical densities.

EXAMPLE 8

Precursor composition for receiver coat:

| | | |
|---|---|---|
| Solution A | Vitel VPE200 | 9.0 parts |
| | toluene | 40.0 parts |
| | methyl ethyl ketone | 40.0 parts |
| Solution B | amino silicone M468 | 0.39 parts |
| | toluene | 10.0 parts |
| Solution C | Diepoxide 126 | 0.06 parts |
| | toluene | 10.0 parts |

The three solutions were prepared and mixed with stirring, then coated onto Melinex '990' and dried as described for Example 1, to give a further receiver sheet according to the invention. When printed using the set of standard dyesheets, a good image was again produced with no sign of adhesion having occured between the sheets during printing.

EXAMPLE 9

Precursor composition for receiver coat:

| | | |
|---|---|---|
| Solution A | Vitel VPE200 | 5.8 parts |
| | Corvic CL4317 | 3.1 parts |
| | toluene | 40.0 parts |
| | methyl ethyl ketone | 40.0 parts |
| Solution B | amino silicone M468 | 0.39 parts |
| | toluene | 10.0 parts |
| Solution C | Diepoxide 126 | 0.06 parts |
| | toluene | 10.0 parts |
| Solution D | DABCO | 0.05 parts |
| | toluene | 1.0 parts |

This was a repeat of Example 6, except that the above precursor composition was used instead of that previously described. The resultant receiver sheet printed to give good, uniform images of high optical density, with no evidence of adhesion having occurred during printing.

EXAMPLE 10

Precursor composition for receiver coat:

| | | |
|---|---|---|
| Solution A | Vitel VPE200 | 5.8 parts |
| | Corvic CL4317 | 3.1 parts |
| | toluene | 40.0 parts |
| | methyl ethyl ketone | 40.0 parts |
| Solution B | amino silicone M468 | 0.39 parts |
| | toluene | 10.0 parts |
| Solution C | Diepoxide 126 | 0.06 parts |
| | toluene | 10.0 parts |
| Solution D | dibutylin dilaurate | 0.05 parts |
| | toluene | 1.0 parts |

Receiver sheets were prepared and printed as in the previous Example, but using the revised precursor composition set out above. No real differences were found between the receiver sheets of these two Examples.

EXAMPLE 11

Precursor composition for receiver coat:

| | | |
|---|---|---|
| Solution A | Vylon 103 | 19.3 parts |
| | toluene | 40.0 parts |
| | methyl ethyl ketone | 40.0 parts |
| Solution B | amino silicone M468 | 0.83 parts |
| | toluene | 10.0 parts |
| Solution C | Diepoxide 126 | 0.14 parts |
| | toluene | 10.0 parts |

The three solutions A, B and C were prepared separately and mixed, with stirring, just before coating. The mixed solution was coated onto Wiggins Teape Glossart paper (specified weight 160 g/sq m), using a No. 8 K bar. This gave a wet coat thickness of 100 microns, resulting in a dry receiver coat of approximately 12 microns thick. On printing as described for Example 1, this receiver sheet gave images of good optical density, with no noticeable adhesion effects.

EXAMPLE 12

Example 11 was repeated except for a change of paper substrate to Wiggins Teape Synteape FPG150 (a synthetic paper). Results very similar to those of the previous Example were obtained.

We claim:

1. A receiver sheet for dye-diffusion thermal transfer printing, comprising a substrate which supports a receiver coat, the receiver coat comprising a dye-receptive material and a dye-permeable release agent, characterised in that the release agent is a thermoset amino-modified-silicone organic-oligoepoxide resin.

2. A receiver sheet as claimed in claim 1, wherein the organic oligoepoxide is a bis-(epoxycyclohexane) with an ester linkage between the cyclohexane residues.

3. A receiver sheet as claimed in claim 2, wherein the dye-receptive material is an organic polymer.

4. A receiver sheet as claimed in claim 1, wherein the receiver coat comprises the release agent dispersed throughout a layer of the dye-receptive material.

5. A receiver sheet as claimed in claim 3, wherein the organic polymer is a compound which is soluble in at least one organic liquid which is also a solvent for the release agent.

6. A receiver sheet as claimed in claim 1, wherein the organic polymer comprises a saturated polyester.

7. A receiver sheet as claimed in claim 1, wherein the receiver coat comprises a plurality of component layers of different compositions, including a first layer comprising the dye-receptive material, and a release coat forming a second layer overlying the first layer and comprising the release agent.

8. A receiver sheet as claimed in claim 7, wherein the release coat comprises a composition in which the release agent is dispersed in a polymeric binder.

* * * * *